US005272680A

United States Patent [19]

Stone et al.

[11] Patent Number: 5,272,680

[45] Date of Patent: Dec. 21, 1993

[54] METHOD OF DECODING MWD SIGNALS USING ANNULAR PRESSURE SIGNALS

[75] Inventors: Frederick A. Stone, Durham; Donald Grosso, West Hartford, both of Conn.; Stephen Wallace, Old Meldrum, Scotland

[73] Assignee: Baker Hughes Incorporated, Houston, Tex.

[21] Appl. No.: 703,480

[22] Filed: May 17, 1991

Related U.S. Application Data

[63] Continuation of Ser. No. 462,414, Jan. 9, 1990, abandoned.

[51] Int. Cl.[5] ..... G01V 1/40

[52] U.S. Cl. ..... 367/85; 367/83; 364/422

[58] Field of Search ..... 340/861; 367/83-85; 364/422

[56] References Cited

U.S. PATENT DOCUMENTS 4,575,261 3/1986 Berger et al. ..... 374/136
4,590,593 5/1986 Rodney ..... 367/83
4,703,461 10/1987 Kotlyar ..... 367/83
4,733,232 3/1988 Grosso ..... 340/861
4,733,233 3/1988 Grosso et al. ..... 340/861
4,866,680 9/1989 Scherbatskoy ..... 367/83
4,878,206 10/1989 Grosso et al. ..... 367/83

OTHER PUBLICATIONS

Bryant et al., "Gas Influx Detection . . . MWD Technology"; IADC/SPE Drilling Conf., Mar. 2, 1990, Proc. pp. 515-529; Abst. only.

Grosso et al., "Report on MWD . . . Downhole Sensors"; J. Petrol. Technol., vol. 35, No. 5, pp. 899-904; May 1983; abst. only.

*Primary Examiner*—Nelson Moskowitz

*Attorney, Agent, or Firm*—Fishman, Dionne & Cantor

[57] ABSTRACT

A method is presented for obtaining borehole measurements using measurement-while-drilling apparatus wherein mud pulse telemetry signals are decoded from the annulus pressure signals (as opposed to the standpipe pressure signals). The data bearing signals are enhanced by combining the annulus pressure signals and standpipe pressure signals using addition, multiplication or correlation techniques.

9 Claims, 4 Drawing Sheets

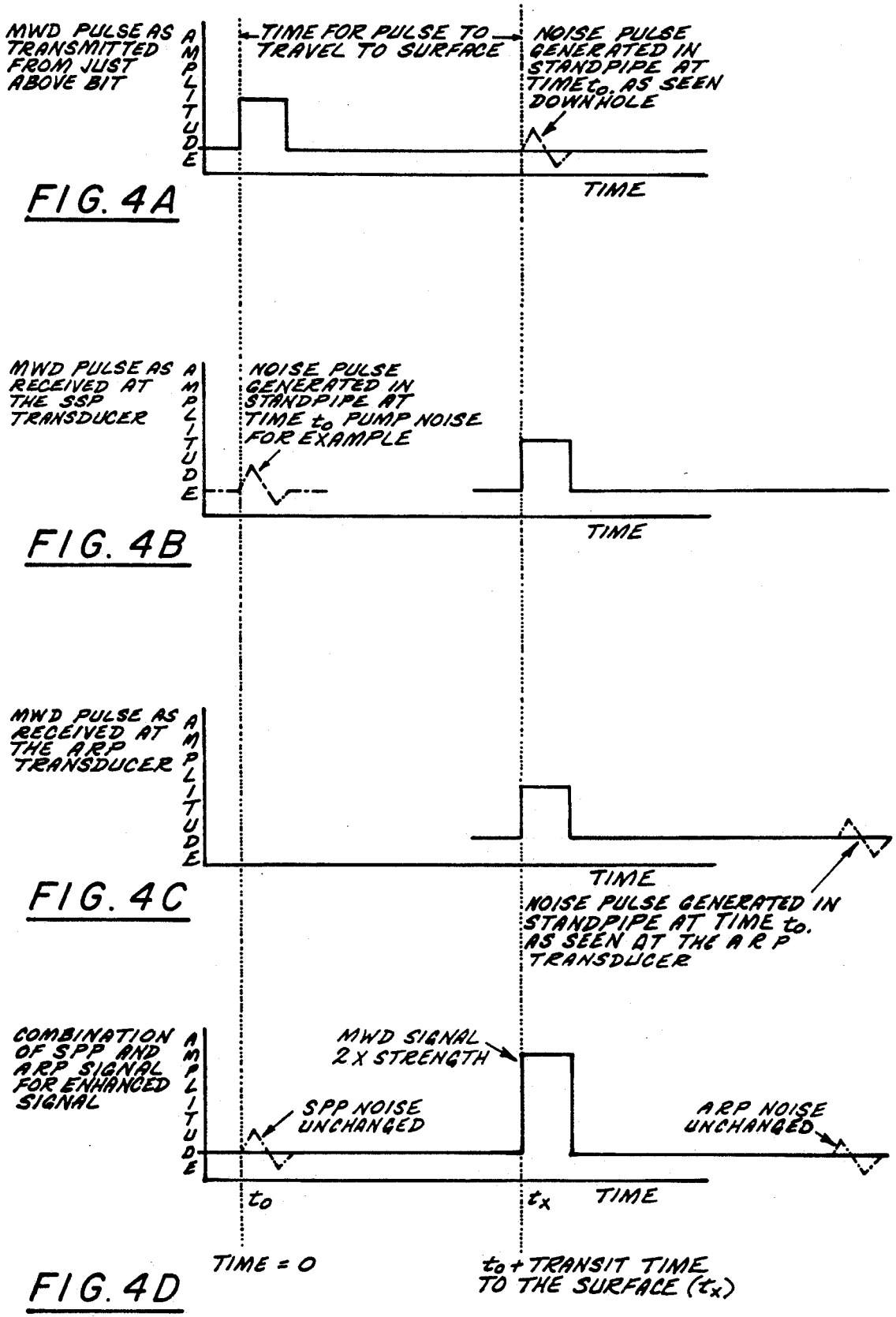
MWD PULSE AS TRANSMITTED FROM JUST ABOVE BIT
AMPLITUDE
TIME FOR PULSE TO TRAVEL TO SURFACE
NOISE PULSE GENERATED IN STANDPIPE AT TIME $t_o$, AS SEEN DOWNHOLE
TIME
FIG. 4A
MWD PULSE AS RECEIVED AT THE SSP TRANSDUCER
AMPLITUDE
NOISE PULSE GENERATED IN STANDPIPE AT TIME $t_o$ PUMP NOISE FOR EXAMPLE
TIME
FIG. 4B
MWD PULSE AS RECEIVED AT THE ARP TRANSDUCER
AMPLITUDE
TIME
NOISE PULSE GENERATED IN STANDPIPE AT TIME $t_o$. AS SEEN AT THE ARP TRANSDUCER
FIG. 4C
COMBINATION OF SPP AND ARP SIGNAL FOR ENHANCED SIGNAL
AMPLITUDE
MWD SIGNAL 2X STRENGTH
SPP NOISE UNCHANGED
ARP NOISE UNCHANGED
$t_o$
$t_x$
TIME
TIME = 0
$t_o$ + TRANSIT TIME TO THE SURFACE ($t_x$)
FIG. 4D

METHOD OF DECODING MWD SIGNALS USING ANNULAR PRESSURE SIGNALS

This is a continuation of copending application Ser. No. 07/462,414 filed on Jan. 9, 1990, now abandoned.

BACKGROUND OF THE INVENTION

This invention relates generally to the field of borehole measurements. More particularly, this invention relates to a new and improved method of obtaining borehole measurements using measurement-while-drilling (MWD) apparatus wherein mud pulse telemetry (MPT) signals are decoded from the annulus pressure signals (as opposed to the standpipe pressure signals).

In the drilling of oil and gas wells, efficient operation of the drilling apparatus, particularly as wells are drilled deeper and offshore activity increases, demands that data of interest to the driller be collected downhole and be sensed and transferred to the surface "continuously" i.e., without the lengthy delays which would be incident to stopping drilling and lowering test instruments down the borehole. In recent years, significant advances have been made in measurement-while-drilling (MWD) technology. For examples of MWD systems for use in the measurement of borehole directional parameters reference may be had to U.S. Pat. Nos. 3,982,431, 4,013,945 and 4,021,774, all of which are assigned to the assignee of the present invention.

The measurement systems of the above-referenced patents utilize mud pulse telemetry to transmit information from the vicinity of the drill bit to the surface drilling platform. Mud pulse telemetry consists of the transmission of information via a flowing column of drilling fluid, i.e., mud, the information commensurate with the sensed downhole parameters being converted into a binary code of pressure pulses in the drilling fluid within the drill pipe or standpipe which are sensed at the surface. These pressure pulses are produced by periodically modulating the flowing mud column at a point downhole by mechanical means, and the resulting periodic pressure pulses appearing at the surface end of the mud column are detected by a pressure transducer conveniently located in the standpipe. The drilling mud is pumped downwardly through the drill pipe (string) and then back to the surface through the annulus between the drill string and the wall of the well for the purpose of cooling the bit, removing cuttings produced by the operation of the drill bit from the vicinity of the bit and containing the geopressure.

Since the inception of mud pulse telemetry (MPT), the MPT signal has been detected at or near the standpipe using standpipe pressure (SPP) signals. Whether the MPT method is positive or negative, all suppliers of MWD services use this technique. This technique has been adequate and successful for "directional" information (i.e., azimuth, inclination, etc.), but is not as successful now that "formation" information (resistivity, gamma, porosity, etc.) is being transmitted while the drill string is engaged in active and often aggressive drilling. During some MWD transmissions, particularly under certain severe drilling conditions, drilling artifacts get in the way of good signal decoding in the standpipe. In fact under certain drilling conditions, the MPT signals in the standpipe cannot be decoded at all and so downhole drilling information in real time (i.e., MWD) cannot be supplied to the driller.

This inability to decode pressure signals in the standpipe is caused by the presence of interfering pressure pulses or noise which lowers the signal-to-noise (SNR) in the standpipe to a level below the threshold of the MWD decoder located on the surface. Analysis has been conducted on the cause of interfering pressure pulses that arrive in the standpipe pressure (SPP) transducer along with the legitimate MPT pulses. It has been determined that the interfering pulses look like signals but are really background noise. This noise reduces the signal to noise ratio (SNR) which is a measure of how successful the signal decode will be. It is not known exactly how all the noise from the drilling operation gets into the pressure wave measured at the SPP transducer, but some of the causes have been identified or tentatively identified as longitudinal drill string vibration, torsional vibration, bit vibration, accumulator resonance, hydraulic resonance in the drill string, pressure waves generated by the drilling fluid pumps and rig vibrations.

As mentioned, the results of these disturbances on the SPP reduces the SNR and therefore the ability to decode the MPT signal. The highly undesirable result is that the driller is unable to use measurement-while-drilling techniques to obtain directional and formation information and must resort to more time consuming and expensive methods of obtaining necessary borehole information.

SUMMARY OF THE INVENTION

The above-discussed problems and deficiencies of the prior art are overcome or alleviated by the mud pulse telemetry (MPT) signal decoding method of the present invention. In accordance with the present invention, it has been discovered that under certain drilling conditions, the annular pressure signal or annular return pressure (ARP), although small, contains a MPT signal that has a SNR which is better than the SNR of the MPT signal in the standpipe. In other words, in certain drilling situations, the several noise generators discussed above (e.g., drill string and bit vibration, pump noise, etc.) has less influence on the ARP signal than on the SPP signal. As a result, critical MWD information from the ARP can be obtained and provided to the driller under conditions where heretofore the driller was unable to have such information because the MPT signal in the stand pipe was (SPP) not decodable.

The discovery of this invention (i.e., that ARP signals may be accurately decoded to provide MWD information) is both unexpected and surprising. While mud pulse telemetry techniques have been known for over fifteen (15) years, MPT signals have only been obtained from the stand pipe for decoding the downhole information. This is because it has heretofore been believed that any MPT signal in the annulus would be so small as to be masked by the noise in the annulus. In addition, it has been thought that if the SNR in the stand pipe was unsatisfactory, the SNR in the annulus would be similarly unsatisfactory and therefore of no use to the driller. However, a significant aspect of the present invention is the discovery that the noise in the annulus is not necessarily commensurate with the noise in the stand pipe (and in fact, may be much smaller) so that under some drilling conditions, the SNR in the annulus is better than the SNR in the stand pipe despite the much smaller MPT signal in the annulus relative to the stand pipe.

The present invention includes several embodiments for improving the decoding of MPT signals. In a first embodiment, the ARP signal is utilized to successfully decode downhole information acquired from the MWD sensors. Preferably, in this first embodiment, means are provided to permit the MWD operator to review the MPT signals in both the stand pipe (SPP) and the annulus (ARP) so that the signals with the best SNR can be used to obtain the lowest bit error. In additional embodiments of this invention, the SPP and ARP signals are combined so as to obtain an overall enhanced MPT signal and therefore obtain an enhanced SNR. This combination may be accomplished using addition, multiplication or correlation. The summation, multiplication and correlation methods associated with the alternative embodiments may be accomplished using known digital signal processing techniques.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES:

FIGS. 4A–4D are graphical illustrations depicting the MPT scheme for the additional embodiments of the present invention;

DESCRIPTION OF THE PREFERRED EMBODIMENT

Figure 1:
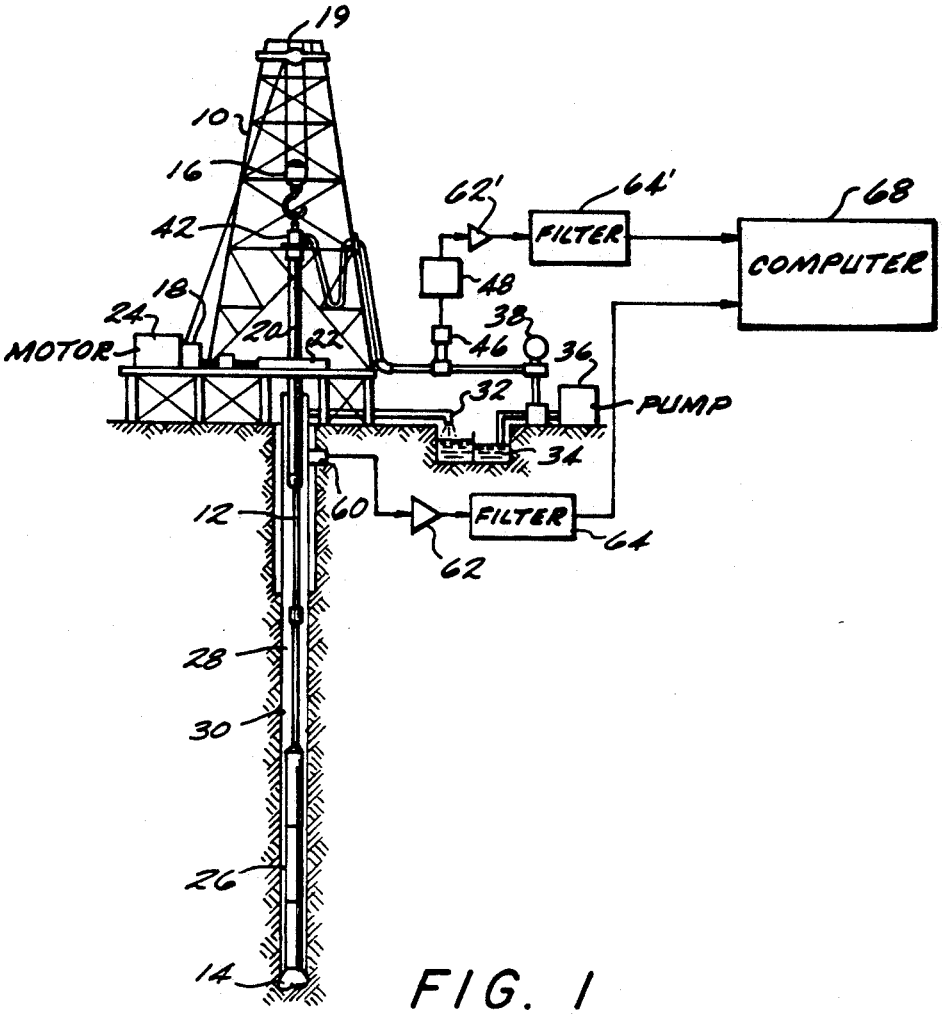
FIG. 1 is a generalized schematic view of borehole drilling apparatus in accordance with the present invention.

Referring to FIG. 1, a drilling apparatus is shown having a derrick 10 which supports a drill string or drill stem, indicated generally at 12, which terminates in a drill bit 14. As is well known in the art, the entire drill string may rotate, or the drill string may be maintained stationary and only the drill bit rotated. The drill string 12 is made up of a series of interconnected pipe segments, with new segments being added as the depth of the well increases. The drill string is suspended from a moveable block 16 of a winch 18 and a crown block 19, and the entire drill string of the disclosed apparatus is driven in rotation by a square kelly 20 which slideably passes through and is rotatably driven by the rotatable table 22 at the foot of the derrick. A motor assembly 24 is connected to both operate winch 18 and drive rotary table 22.

The lower part of the drill string may contain one or more segments 26 of larger diameter than the other segments of the drill string. As is well known in the art, these larger diameter segments may contain sensors and electronic circuitry for preprocessing signals provided by the sensors. Drill string segments 26 may also house power sources such as mud driven turbines which drive generators, the generators in turn supplying electrical energy for operating the sensing elements and any data processing circuitry. An example of a system in which a mud turbine, generator and sensor elements are included in a lower drill string segment may be seen from U.S. Pat. No. 3,693,428 to which reference is hereby made.

Drill cuttings produced by the operation of drill bit 14 are carried away by a mud stream rising up through the free annular space 28 between the drill string and the wall 30 of the well. That mud is delivered via a pipe 32 to a filtering and decanting system, schematically shown as tank 34. The filtered mud is then drawn up by a pump 36, provided with a pulsation absorber 38, and is delivered via line 40 under pressure to revolving injector head 42 and then to the interior of drill string 12 to be delivered to drill bit 14 and the mud turbine in drill string segment 26.

Figure 2:
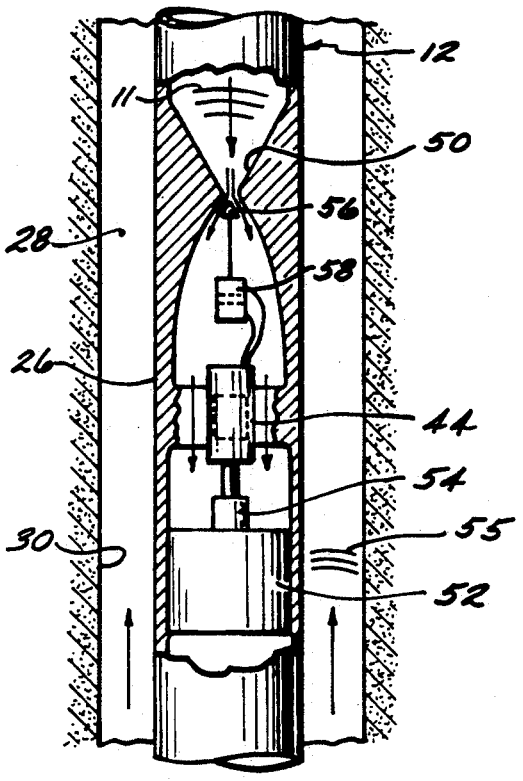
FIG. 2 is a schematic representation of a mud apparatus using mud pulse telemetry.

In a MWD system as illustrated in FIG. 2, the mud column in drill string 12 serves as the transmission medium for carrying signals of downhole drilling parameters to the surface. This signal transmission is accomplished by the well known technique of mud pulse generation or mud pulse telemetry (MPT) whereby pressure pulses represented schematically 11 are generated in the mud column in drill string 12 representative of parameters sensed downhole.

Figure 3A:
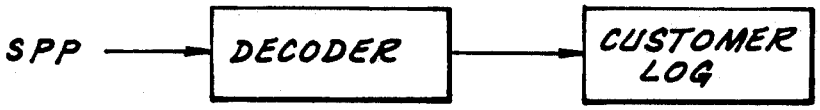
FIG. 3A (PRIOR ART)
FIG. 3A is a block diagram depicting the MPT scheme in accordance with the prior art.

The drilling parameters may be sensed in a sensor unit 44 in drill string segment 26, as shown in FIG. 1 which is located adjacent to the drill bit. In accordance with well known techniques and as depicted in FIG. 3A, the pressure pulses 11 established in the mud stream in drill string 12 are received at the surface by a pressure transducer 46 and the resulting electrical signals are subsequently transmitted to a signal receiving and processing device 48 which may record, display and/or perform computations on the signals to provide information of various conditions downhole.

Still referring to FIG. 2, the mud flowing down drill string 12 is caused to pass through a variable flow orifice 50 and is then delivered to drive a turbine 52. The turbine 52 is mechanically coupled to, and thus drives the rotor of a generator 54 which provides electrical power for operating the sensors in the sensor unit 44. The information bearing output of sensor unit 44, usually in the form of an electrical signal, operates a valve driver 58, which in turn operates a plunger 56 which varies the size of variable orifice 50. Plunger 56 may be electrically or hydraulically operated. Variations in the size of orifice 50 create the pressure pulses 11 in the drilling mud stream and these pressure pulses are sensed at the surface by aforementioned transducer 46 to provide indications of various conditions which are monitored by the condition sensors in unit 44. The direction of drilling mud flow is indicated by arrows on FIG. 2. The pressure pulses 11 travel up the downwardly flowing column of drilling mud and within drill string 12.

Sensor unit 44 will typically include means for converting the signals commensurate with the various parameters which are being monitored into binary form, and the thus encoded information is employed to control plunger 56. The sensor 46 at the surface will detect pressure pulses in the drilling mud stream and these pressure pulses will be commensurate with a binary code. In actual practice the binary code will be manifested by a series of information bearing mud pulses of two different durations with pulse amplitude typically being in the range of 30 to 350 psi. The transmission of information to the surface via the modulated drilling mud stream will typically consist of the generation of a preamble followed by the serial transmission of the encoded signals commensurate with each of the borehole parameters being monitored.

As noted above, the drilling mud, after passing downwardly through segment 26 of the drill string, washes the drill bit 14 and then returns to the surface via the annulus 28 between the drill string and the wall 30 of the well. As discussed in U.S. Pat. Nos. 4,733,232 and 4,733,233, both of which are assigned to the assignee hereof, it has earlier been discovered that the pressure pulses resulting from the movements imparted to plunger 56, also travel down the drill string and are propagated from the bottom of the well (although in greatly attenuated form) and result in pulses indicated schematically at 55 in FIG. 2 in annulus 28 which may be sensed at the surface. In order to measure this second annulus pressure pulse or annulus return pulse (ARP), as shown in FIG. 1, a second pressure transducer 60 is located at the surface and upstream, in the direction of returning mud flow, from pipe 32. Typically, the magnitude of the pressure pulses detected by transducer 60 are at least an order of magnitude less than the corresponding or companion pressure pulses detected by transducer 46. Nevertheless, through the use of appropriate filtering, these low magnitude pressure pulses in the annulus may be detected.

Figure 3B:
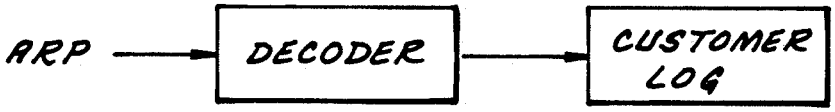
FIG. 3B is a block diagram depicting the MPT scheme in accordance with a first embodiment of the present invention.

In accordance with the present invention, it has been unexpectedly discovered that ARP signal may be decoded to obtain useful borehole information acquired from the MWD sensors (see FIG. 3B). This discovery is both surprising and unexpected as it has been generally believed that the ARP signal was so weak that it would be masked by the noise generated downhole from the several noise sources described above. An important feature of the present invention is the discovery that the SNR in the annulus is not merely commensurate to the SNR in the standpipe. Instead, it has been found that the SNR in the annulus may be much better than the SNR in the standpipe under certain drilling conditions. The ability to decode a mud pulse telemetry signal during conditions unfavorable to conventional standpipe pressure signal detection has significant importance to the field of MWD since it will enable MWD measurements in situations where it has heretofore been impossible to obtain such measurements. In the following example, the significance of the present invention is clearly shown.

EXAMPLE

Figure 6A:
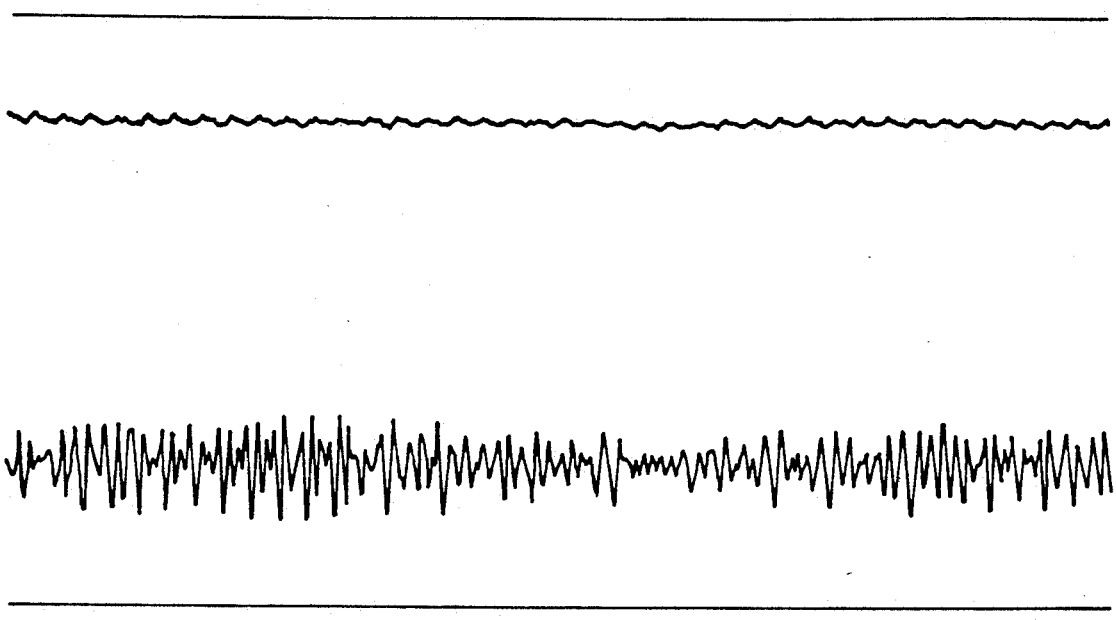
FIGS. 6A and 6B are logs depicting raw MWD data from an actual drilling operating showing SPP and ARP, respectively.
Figure 6B:
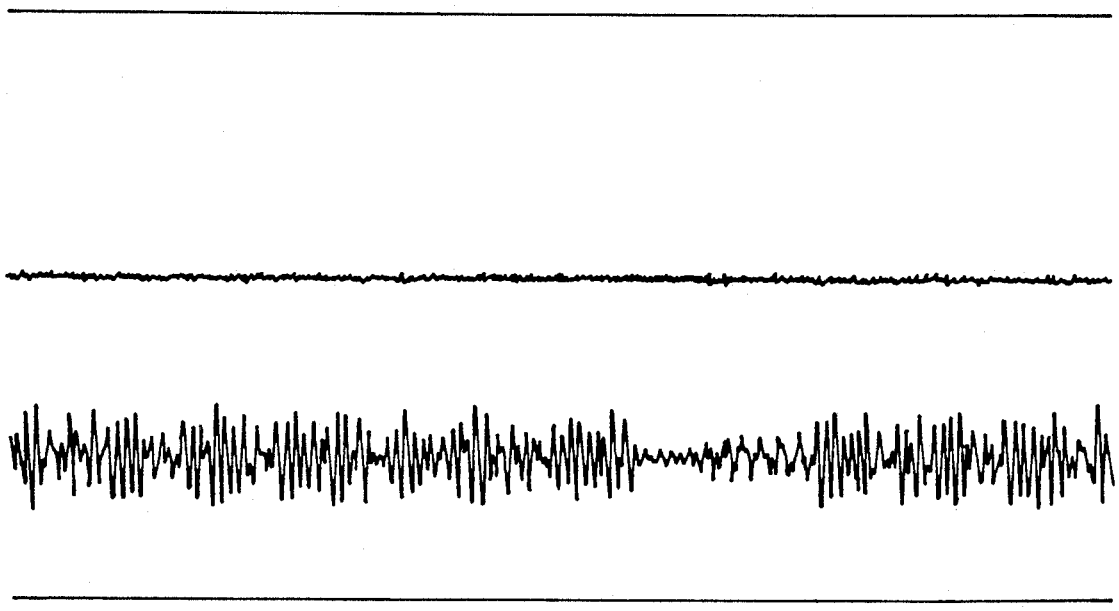

Experimental MWD measurements were conducted from an oil exploration platform in the North Sea. While attempting to sense and decode MPT signals in the standpipe (SPP signals) in a conventional manner, a large amount of noise was encountered. The noise was so strong that it totally masked the SPP signal so that the standpipe signal was undecodable. FIG. 6A depicts a log showing the undecodable raw data from the SPP. After trying to manipulate the drilling parameters for some time in an effort to minimize the noise, an annular pressure pulse sensor was connected into the "Standpipe Signal In" on the decoding apparatus. The result was unexpected and surprising with the immediate decoding of the ARP signal into useful downhole MWD information (see FIG. 6B). The ARP signal was decoded from 10,400 feet downwardly to about 10,888. Throughout this section of drilling, both the SPP and ARP signals were monitored, but there were few periods where the SPP would have been decodable. Thus, MWD information could be supplied to the driller only through use of the ARP signal.

Referring again to FIG. 1, in a preferred embodiment, both the SPP and ARP signals are monitored so that the sensed signal having the lowest SNR and/or distortion will be used to decode the downhole information. Thus, at the surface the standpipe pressure variations will be detected by transducer 46 to produce SPP signal. Similarly, the pressure variations (reflected pulses) in the annulus will be detected by transducer 60 and the resulting ARP signal will be conditioned in circuitry which may include an amplifier 62 and filter 64. The computer 68 may be used to compare the SNR of both the SPP and ARP and to select the signal having most favorable SNR for decoding purposes.

Alternatively, the SPP and ARP signals may be monitored for comparison of still other criteria or parameters (as opposed to SNR and distortion) in order to select the "best" signal to use. These other criteria include comparing each signal to select the lowest bit error rate or comparing each signal to select the signal which has the most probable decode. An example of a signal having the most probable decode is in the case where the encoded MWD information includes parity. Thus, if the ARP signal includes a correct parity signal and the SPP signal contains an incorrect parity signal, then the ARP signal is detected.

Preferably, the ARP transducer 60 should be located as far downhole as is possible to develop a sufficient pressure head (since the ARP signal is so weak). However, in practice, the ARP transducer will be located just above the blow out preventor (BOP).

Referring now to FIGS. 4A–4D, in another embodiment of this invention, the two MWD signals (ARP signal and SPP signal) are used in concert to produce a more reliable decoded data. It will be appreciated that the SPP signal and the ARP signal have the MWD pulse in common. The noise on the other hand is not necessarily so related. For example, the pump noise is seen at the SPP transducer unattenuated and very soon in time after it leaves the generating source. The pump noise seen in the annulus at the ARP transducer, however is (1) attenuated by effects of traveling twice down the drill pipe and up the annulus, and (2) displaced in time by the length of the trip and the speed of the pulse (roughly the speed of sound in that medium). This example implies that, in general, the noise as seen at the SPP and ARP from what ever source may be different in amplitude with respect to the signal and displaced in time. Furthermore, the noise coupled into the SPP signal may couple differently, or not at all, into the ARP. Based on this concept, an enhanced signal can be achieved by combining the common signal information of the two signals. A graphical example is shown in FIGS. 4A–4D and a means of implementation is shown in FIG. 5.

FIGS. 4A–4D show a noise pulse generated in the standpipe near the SPP transducer. This pulse travels downhole and back to the surface and is delayed by the transit time. The time at which the SPP transducer sees the noise pulse and the time the ARP transducer sees the noise pulse is different. Thus, when the SPP and ARP signals are summed as shown in FIG. 1, (or multiplied, or cross-correlated), the signal present in both waveforms will be reinforced while any time uncorrelated noise will remain the same amplitude or be reduced. In the example of FIG. 4, the noise after summing is located in two places equal to the original size, but the signal is doubled. Thus, the SNR is doubled. As signal decodability is directly related to the SNR, the decodability is enhanced by this technique. It will be appreciated that the ARP signal will be smaller than the SPP signal, depending on where and how it is picked up. There will, however, be a constant gain relationship between these two signals which can be measured and adjusted out. Similarly, there may be a slight time displacement which is generally of little concern. This effect will vary with depth and flow rate but, if important, can be calculated and removed with the correlation technique. The signal processing techniques needed to perform the addition, multiplication and cross-correlation steps are all well known electronic signal processing steps.

Figure 5:
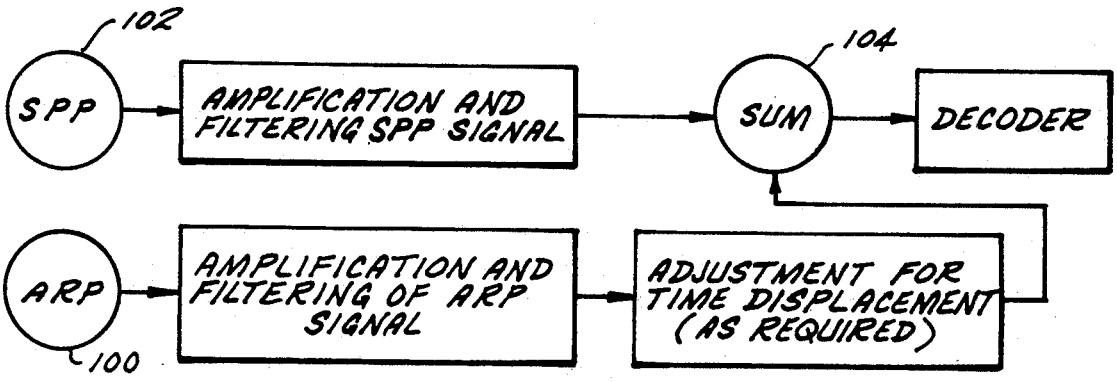
FIG. 5 is a block diagram depicting the MPT scheme for the embodiments of FIG. 4.

FIG. 5 shows a block diagram showing how the technique of FIG. 4 can be implemented. The amplification of the ARP signal 100 is adjusted so that it is similar in size to the SPP signal 102. This is primarily a function of the selected, commercially available, transducers. The time displacement adjustment, when required, can be implemented with a common "all pass filter" to line up SPP and ARP signals. This process can be automated with a correlation calculation or, quite simply measured by eye from the simultaneous strip chart record of the two signals, and the measured delay entered into the all pass filter. As mentioned, the summation step 104 may comprise an algebraic sum of the two signals, a multiplication or a correlation.

In an alternate embodiment of this invention, return flow in the annulus is monitored as opposed to return pressure pulses. As is known, the mud pulser will cause instantaneous changes in drilling fluid flow. Those changes in flow will be commensurate with the pressure pulses being generated by the mud pulser. Thus, a flow meter may be used at 60 in FIG. 1 (as opposed to a pressure transducer); and changes in flow can be measured and decoded to obtain the downhole information acquired from the MWD sensor means.

As mentioned, it is known from U.S. Pat. Nos. 4,733,232 and 4,733,233 that the mud pulse transmitter located in the drill pipe will also provide a detectable pressure pulse in the annulus. However, what has not been known, nor suggested in either of these two patents, is that the annulus pressure pulse signals contain information which can be accurately decoded to obtain the information acquired downhole by the MWD sensors. Similarly, neither of these patents suggests or teaches that the SNR of the ARP signal may be improved relative to the SNR of the SPP signal.

Both of the above mentioned patents relate to methods of sensing an indication of fluid influx into a borehole. U.S. Pat. No. 4,733,233 utilizes the mud pulse generator to accomplish this fluid influx detection. In U.S. Pat. No. 4,733,233, the pressure in the annulus between the standpipe (drill pipe or string) and wall of the well is monitored at the surface. Frequency or amplitude modulation of the mud flow in the standpipe by operation of a valve or plunger to generate, e.g. MWD directional signals in accordance with the teaching of the previously referenced U.S. Pat. Nos. 3,982,431, 4,013,945 and 4,021,774, will result in the mud flow in the annulus containing propagations of the MWD signals in the standpipe. Pressure monitoring of the mud flow in the annulus at the surface thus results in the detection of the propagated signals resulting from modulation of the column of drilling mud in the drill string. In one application of the method disclosed in U.S. Pat. No. 4,733,233, the pressure variations detected in the annulus are compared to pressure variations detected in the standpipe. A significant change in phase and/or amplitude ratio which constitutes a significant deviation from a previously established history, will indicate that there is a fluid influx into the annulus since fluid, for example gas, flowing into the drilling mud will produce attenuation of the modulated information and/or will affect the transmission velocity. In accordance with a second application of the method of U.S. Pat. No. 4,733,233, the pressure variations in the drilling mud flowing up the annulus are computed with near past history of such annulus pressure variations and, after appropriate compensation for any changes which have been made in the drilling operation, the results of the comparison are used for fluid influx detection. When the annulus signal is lost or severely altered in either amplitude or arrival time or both, an alarm may be instituted indicating that fluid has entered the borehole.

As noted above, there is no suggestion in U.S. Pat. No. 4,733,233 that the annulus pressure pulse signal may be decodable and decoded to provide the downhole information which has been acquired from the MWD sensors and encoded in the serial pulses. Nor is there any suggestion that the SNR in the annulus is improved relative to the SNR in the standpipe. U.S. Pat. No. 4,733,233 (and 4,733,322) only uses the ARP to measure its phase and/or amplitude or for a self-comparison over time; it does not decode the ARP to obtain downhole measurements acquired from the MWD sensors.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of decoding downhole information in a well drilling operation, the drilling operation comprising the use of a tubular drill pipe having a diameter which is less than the diameter of a borehole being formed wherein a generally annular space is defined between the drill pipe and the borehole, said decoding being performed during the drilling of the borehole, and in which drilling fluid is pumped down the interior of the drill pipe, the drilling fluid exiting at about the base of the drill pipe and returning to the surface via the generally annular space between the drill pipe and borehole wall, and in which downhole information is acquired using MWD sensor means in the drill pipe and wherein the downhole information is encoded as data bearing signals in the form of pressure pulses which are transmitted to the surface in the drilling fluid by the operation of mud pulse telemetry means in the drill string and detected at the surface, the method comprising the steps of:

sensing in said annular space propagated pressure pulses of the encoded MWD signal pulses impressed in the drilling fluid in the drill pipe, said annular propagated pressure pulses defining annular return pressure pulses; and decoding the sensed annular return pressure pulses to obtain the downhole information acquired from the MWD sensor means.

2. A method of decoding downhole information in a well drilling operation, the drilling operation comprising the use of a tubular drill pipe having a diameter which is less than the diameter of a borehole being formed wherein a generally annular space is defined between the drill pipe and the borehole, the drill pipe terminating at a stand pipe, said decoding being performed during the drilling of the borehole, and in which drilling fluid is pumped down the interior of the drill pipe, the drilling fluid exiting at about the base of the drill pipe and returning to the surface via the generally annular space between the drill pipe and borehole wall, and in which downhole information is acquired using MWD sensor means in the drill pipe and wherein the downhole information is encoded as data bearing signals in the form of pressure pulses which are transmitted to the surface in the drilling fluid by the operation of mud pulse telemetry means in the drill string and detected at the surface, the method comprising the steps of:

sensing in said annular space propagated pressure pulses of the encoded MWD signal pulses impressed in the drilling fluid in the drill pipe, said annular propagated pressure pulses defining annular return pressure pulses;

sensing in said stand pipe propagated pressure pulses of the encoded MWD signal pulses impressed in the drilling fluid in the drill pipe, said stand pipe propagated pressure pulses defining stand pipe pressure pulses;

calculating the signal-to-noise ratio (SNR) and/or distortion measurement of signals in the stand pipe pressure pulses to obtain a first SNR and/or distortion measurement;

calculating the SNR and/or distortion measurement in signals in the annular return pressure pulses to obtain a second SNR and/or distortion measurement;

comparing the first and second SNR and/or distortion measurement; and decoding the sensed annular return pressure pulses or stand pipe pressure pulses in response to the lower first or second SNR and/or distortion measurement to obtain the downhole information acquired from the MWD sensor means.

3. A method of decoding downhole information in a well drilling operation, the drilling operation comprising the use of a tubular drill pipe having a diameter which is less than the diameter of a borehole being formed wherein a generally annular space is defined between the drill pipe and the borehole, the drill pipe terminating at a stand pipe, said decoding being performed during the drilling of the borehole, and in which drilling fluid is pumped down the interior of the drill pipe, the drilling fluid exiting at about the base of the drill pipe and returning to the surface via the generally annular space between the drill pipe and borehole wall, and in which downhole information is acquired using MWD sensor means in the drill pipe and wherein the downhole information is encoded as data bearing signals in the form of pressure pulses which are transmitted to the surface in the drilling fluid by the operation of mud pulse telemetry means in the drill string and detected at the surface, the method comprising the steps of:

sensing in said annular space propagated pressure pulses of the encoded MWD signal pulses impressed in the drilling fluid in the drill pipe, said annular propagated pressure pulses defining annular return pressure pulses;

sensing in said stand pipe propagated pressure pulses of the encoded MWD signal pulses impressed in the drilling fluid in the drill pipe, said stand pipe propagated pressure pulses defining stand pipe pressure pulses;

combining the signals from the stand pipe pressure pulses and the annular return pressure pulse; and decoding the combined signals to obtain enhanced data bearing signals representative of the downhole information acquired from the MWD sensor means.

4. The method of claim 3 wherein:

said combination step comprises summation of the signals.

5. The method of claim 3 wherein:

said combination step comprises multiplication of the signals.

6. The method of claim 3 wherein:

said combination step comprises cross-correlation of the signals.

7. A method of decoding downhole information in a well drilling operation, the drilling operation comprising the use of a tubular drill pipe having a diameter which is less than the diameter of a borehole being formed wherein a generally annular space is defined between the drill pipe and the borehole, said decoding being performed during the drilling of the borehole, and in which drilling fluid is pumped down the interior of the drill pipe, the drilling fluid exiting at about the base of the drill pipe and returning to the surface via the generally annular space between the drill pipe and borehole wall, and in which downhole information is acquired using MWD sensor means in the drill pipe and wherein the downhole information is encoded as data bearing signals in the form of pressure pulses which are transmitted to the surface in the drilling fluid by the operation of mud pulse telemetry means in the drill string and detected at the surface, the method comprising the steps of:

sensing in said annular space changes in flow caused by operation of the mud pulse telemetry means, said changes in flow defining annular return flow changes; and decoding the sensed annular return flow changes to obtain the downhole information acquired from the MWD sensor means.

8. A method of decoding downhole information in a well drilling operation, the drilling operation comprising the use of a tubular drill pipe having a diameter which is less than the diameter of a borehole being formed wherein a generally annular space is defined between the drill pipe and the borehole, the drill pipe terminating at a stand pipe, said decoding being performed during the drilling of the borehole, and in which drilling fluid is pumped down the interior of the drill pipe, the drilling fluid exiting at about the base of the drill pipe and returning to the surface via the generally annular space between the drill pipe and borehole wall, and in which downhole information is acquired using MWD sensor means in the drill pipe and wherein the downhole information is encoded as data bearing signals in the form of pressure pulses which are transmitted to the surface in the drilling fluid by the operation of mud pulse telemetry means in the drill string and detected at the surface, the method comprising the steps of:

sensing in said annular space propagated pressure pulses of the encoded MWD signal pulses impressed in the drilling fluid in the drill pipe, said annular propagated pressure pulses defining annular return pressure pulses;

sensing in said stand pipe propagated pressure pulses of the encoded MWD signal pulses impressed in the drilling fluid in the drill pipe, said stand pipe propagated pressure pulses defining stand pipe pressure pulses;

monitoring a selected parameter of signals in the stand pipe pressure pulses to obtain a first monitored parameter;

monitoring a selected parameter of signals in the annular return pressure pulses to obtain a second minitored parameter;

comparing the first and second monitored parameters; and decoding the sensed annular return pressure pulses or stand pipe pressure pulses in response to the first or second monitored parameters.

9. The method of claim 8 wherein:

said first and second monitored parameters are selected from the group consisting of SNR, distortion measurements, bit error rates or parity signals.

* * * * *